US008167310B2

(12) United States Patent
Ruggiero

(10) Patent No.: US 8,167,310 B2
(45) Date of Patent: May 1, 2012

(54) TRANSPORTABLE WASHER TOSSING GAME RETRIEVING POLE

(76) Inventor: Daniel Ruggiero, Point Pleasant, NJ (US)

( * ) Notice: Subject to any disclaimer, the term of this patent is extended or adjusted under 35 U.S.C. 154(b) by 241 days.

(21) Appl. No.: 12/660,902

(22) Filed: Mar. 8, 2010

(65) Prior Publication Data

US 2011/0031697 A1 Feb. 10, 2011

Related U.S. Application Data

(60) Provisional application No. 61/273,637, filed on Aug. 7, 2009.

(51) Int. Cl.
*A63B 71/00* (2006.01)

(52) U.S. Cl. ..... 273/317; 273/348; 294/190

(58) Field of Classification Search ..... 273/336–339, 273/348, 398–402, 317; 294/19.2, 190
See application file for complete search history.

(56) References Cited

U.S. PATENT DOCUMENTS

| | | | | |
|---|---|---|---|---|
| 5,381,319 | A * | 1/1995 | Shiao | 362/120 |
| 5,472,211 | A * | 12/1995 | McCaughan | 273/401 |
| 5,472,251 | A * | 12/1995 | Deininger | 294/19.2 |
| 6,312,138 | B1 * | 11/2001 | Coleman et al. | 362/120 |
| 6,951,224 | B2 * | 10/2005 | Garrett | 135/66 |
| 7,052,155 | B2 * | 5/2006 | Gavin et al. | 362/120 |
| 2008/0261714 | A1 * | 10/2008 | Bae | 473/286 |
| 2011/0012382 | A1 * | 1/2011 | Wang | 294/19.1 |
| 2011/0031697 | A1 * | 2/2011 | Ruggiero | 273/398 |

* cited by examiner

*Primary Examiner* — Raleigh W. Chiu
(74) *Attorney, Agent, or Firm* — Charles I. Brodsky

(57) ABSTRACT

For an accuracy scoring game having a target area towards which steel washers are tossed when playing, a telescopic retrieving pole of multiple sections capable of collapsing into one another for closure and storage and of extending from one another for opening, including a first end for player hand grasping and a second opposite end forming a first compartment of one or more embedded magnets for picking up steel washers from the ground, and in which the retrieving pole, when collapsed, is of a dimension to fit within a carry box for the target area and for the steel washers when the game is not being played.

9 Claims, 1 Drawing Sheet

TRANSPORTABLE WASHER TOSSING GAME RETRIEVING POLE

CROSS-REFERENCE TO RELATED APPLICATIONS

A Provisional Patent Application covering the invention described herein was filed on Aug. 7, 2009, and assigned Ser. No. 61/273,637.

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

NOT APPLICABLE

BACKGROUND OF THE INVENTION

1. Field of the Invention

This invention relates to washer tossing games, in general, and to an apparatus for simplifying the play of the game and its storage, in particular.

2. Description of the Related Art

As is understood, washer tossing games often entail players pitching or throwing washers toward scoring boxes having interior portions for capturing the tossed object, or toward other target areas. As is also understood, in some versions scoring points are awarded based on how close the washer is tossed to the center of the target in a manner similar to that with horseshoe pitching contests. As will be further understood, the popularity of such washer games is such that even league competitions have been established where the participants stand 10, 15 and 20 feet away from the target to which the washer is being tossed. As will be additionally understood, these washer tossing games are also played at such outdoor events as picnics, barbecues, and family gatherings. Especially in those environments, loose washers are frequently and easily lost during the competition which ensues.

Problems arise when playing the washer tossing game in these family-type settings. For example, when striking the ground, the washers tend to bounce and roll away from the scoring box or target area. Oftentimes, the washers roll under nearby tables and chairs where they easily become hidden. Frequently, because of the simplicity of the game and the ease with which the washers can be tossed, older players are invited to participate—including those who find it difficult to bend and pick up the washers from the ground once the washers have stopped rolling around. Other times, especially at these picnic and barbecue settings, game participants may have imbibed a little too many alcoholic beverages, which results in their staggering and possibly falling when bending over to retrieve the washers. And, typically with older participants, "bad backs" are part of their physical make up, which prevents them from easily picking up the washers and joining in the competition. Whether playing the game at a picnic, or at a barbecue, or when out camping, or just in one's own backyard, retrieving the washers from under tables or chairs, from under grills, from the bushes or just in general from any hard to reach place, something to help a player in this respect will be seen to be quite desirable.

OBJECTS OF THE INVENTION

It is an object of the present invention, therefore, to provide an apparatus which allows a player to more easily pick washers up from the ground in playing a washer tossing game.

Recognizing that most washer tossing games comprise a scoring box and an overlying cover to secure the washers and protect the scoring target areas, it is an object of the invention, also, to provide such apparatus which can be housed within the scoring box when the game is not being played, and which can be secured in the same scoring box package when being carried about.

Whether the washer tossing game includes a mat with a center hole for purposes of scoring, or a plurality of concentric scoring rings, a plurality of circular cup-like receivers, or cups of different sizes attached together, or just having a center scoring pin as in the game of horseshoes, it is a further object of the invention to provide the apparatus of the invention in a manner that can be simply understood and utilized almost instantly, and by all ages of players, from the very young to those of elderly grandparent age, whether physically challenged or not.

SUMMARY OF THE INVENTION

As will be seen from the following description, the present invention follows from the observation that in almost all these washer tossing games, the washer is constructed of steel. In particular, however—and as will be understood by those skilled in the art—, the present invention satisfies the objectives set out, and provides the results desired, for any type material having magnetic properties. In accordance with the teachings of the invention, specifically, it will be seen that these objectives are satisfied and the goals achieved by providing a multi-section telescoping pole with an embedded magnet or magnets at an end opposite from its handle end. The inclusion of the magnet(s) will be understood to allow the washer to be picked up and retrieved without bending, with the telescopic arrangement of the pole being such as to allow its lengthening and usage by players of different height and bending capabilities. At the same time, with appropriate dimensions, a transportable washer retrieving pole of the invention can be closed downwardly to a size that it can be easily fit into and secured with, the carrying box for the washers and target area which define the parameters of the game being played.

BRIEF DESCRIPTION OF THE DRAWINGS

These and other features of the present invention will be more clearly understood from a consideration of the following description taken in connection with the accompanying drawings, in which.

DETAILED DESCRIPTION OF THE INVENTION

At the outset, it will be understood that any type of configuration and construction which allows for selectively adjusting the length of a pole from an initial position may be employed. Whether the pole can be lengthened simply by pulling out one of several sections after another and then locking each section in place by a knob, or whether detents are provided along the lengths of the pole sections to fit within capturing orifices, or in any manner by which the sections can be pulled out and then collapsed, it will be recognized that once the possible extensions are all closed shut, the overall length of the pole can be such as to fit within the storage carry box for the washers game.

Figure 1:
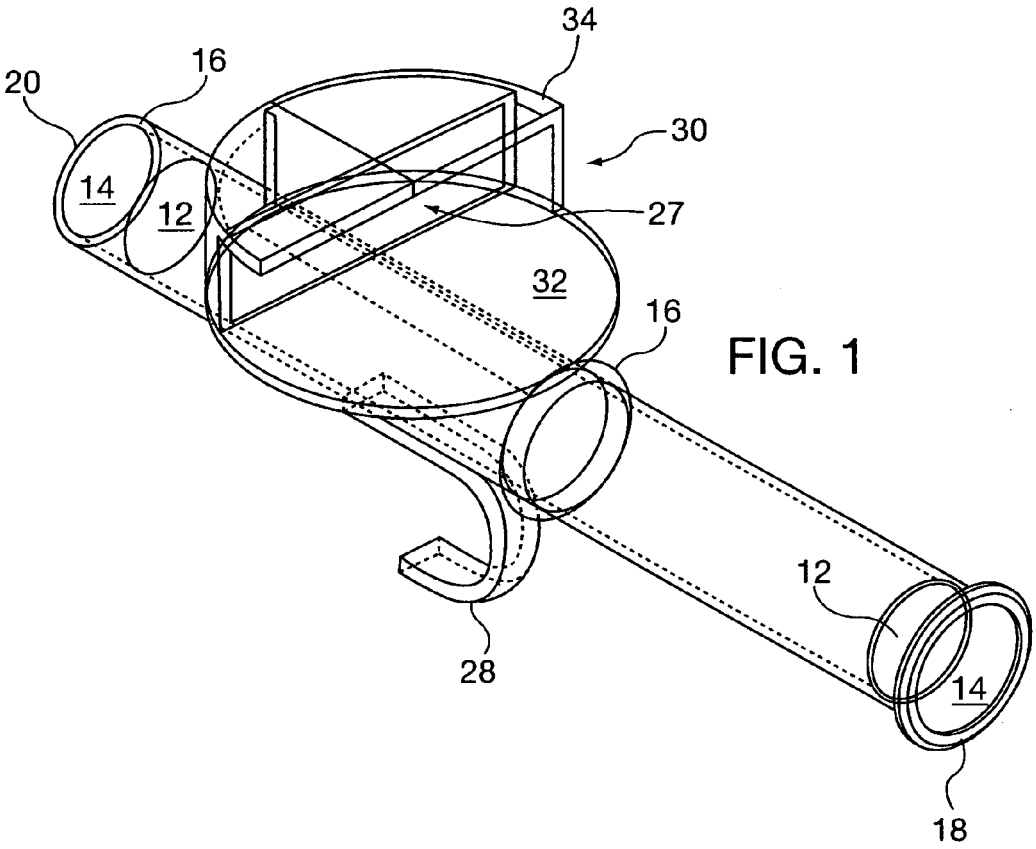
FIGS. 1 and 2 respectively illustrate in partially phantom view the transportable washer retrieving pole of the invention in its collapsed form for storage and in its extended form for use.
Figure 2:
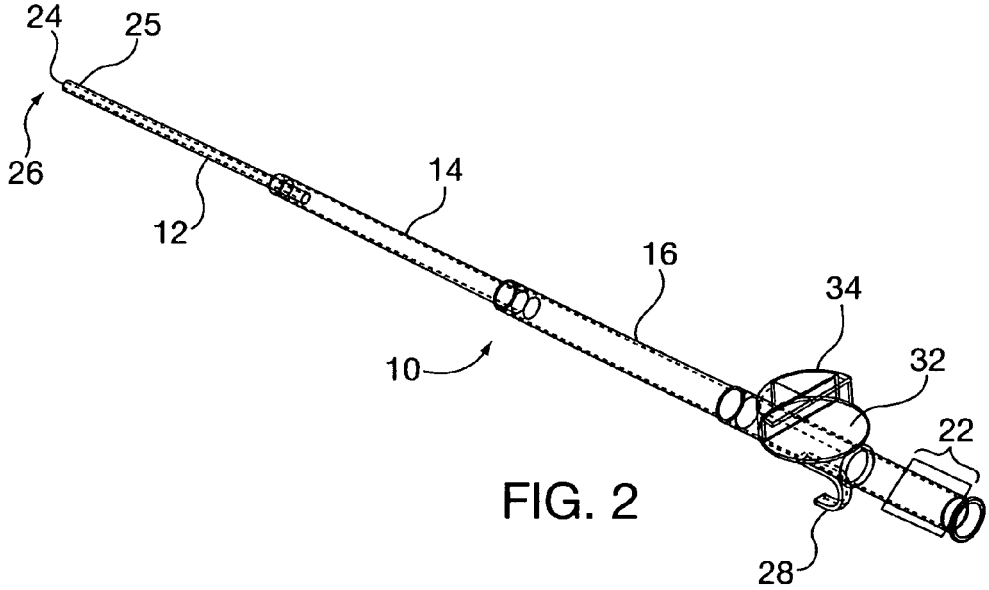

Thus, as for the washer game pole 10 of FIGS. 1 and 2, with the left-most pole section 12 collapsed into the intermediate section 14 as collapsed into the base section 16, the overall length of the 3-section pole 10 as measured from its hilt 18 to its end 20 may be substantially 9 inches. With the section 12 pulled fully outward from the section 14, in turn pulled outward from the section 16, the length of the washer pole 10 may preferably be extended to some 30 inches, measured again between the hilt 18 and the end 20. Although any type of handle 22 may be employed with the pole 10 where desired, one of a rubberized composition, if utilized, is preferable, measured some 4 inches or so from the hilt 18. Any type of lock or detent arrangement also may be employed, if desired, to secure the sections 12 and 14, and the sections 14 and 16, once extended for use, or to collapse them for later storage. With the arrangement of FIG. 2, on the other hand, it is to be understood that the dashed-lines delineate a narrowing taper of the sections 16 into 14, and 14 into 12 so as to provide the securement when the pole is extended.

In accordance with the invention, the section 12 includes one or more embedded magnets 24 in a compartment 25 at its remote end 26 whose strength is such as to singly, or together (if more than one magnet is employed), pick up one, two or three steel washers, serially, one after the other, in using the pole 10 as a magnetic pick up of the washers. This is so wherever on the ground the washers may happen to come to rest and be located at.

Two curvilinear portions 28 and 30 are also included. The first, 28, downwardly extending from an underside of the pole and secured in any appropriate manner with the base section 16 of the washers pole 10, allows the pole to hook onto one's belt, or pockets, or pants, to be there held in place while the washers are being tossed, to then be removed therefrom in allowing the pole to be grasped at the handle 22 when the time comes to retrieve the washers from off the ground. Such hook portion 28, with a 1 inch diameter and a thickness of some ¼ inch, for example, may be of a plastic composition.

The second portion 30, upwardly extending from a top side of the pole, comprises a circular disc 32, overlain by a clasp 34 spaced from the disc 32, and of a diameter and spacing to allow the insertion and storage of the washers in the compartment 27 between them when the game is to be packed away for storage.

In the collapsed position of FIG. 1, with or without the steel or like magnetic washers inserted in compartment 27, the collapsed length of the washer pole would be about 9 inches; once the pole 10 is extended, as in FIG. 2, an overall length of 30 inches, on the other hand, can easily be had. As will be understood, this allows the use of the pole by players of different height characteristic when reaching for, and retrieving, washers on the ground with limited, if any, need to bend over. At the same time, it allows the washer pole 10 to be collapsed to be stored within the carry box for the washer game.

Analysis has shown that a dimension of ⅞ inches for the diameter of the pole is beneficial for use in employing the washer pole 10 to pick up the steel or like magnetic washers from the ground. The compartment 25 in the section 12 will be appreciated to comprise one, two, three or more magnets to pick up and hold the washer discs as desired. With a typical playing of a washer tossing game with a steel washer of some 2 inch outer diameter and some 1 inch inner diameter, three magnets were employed in the compartment 25 in the preferred construction, to retrieve and hold three washers originally stored within the compartment 27. This facilitated transporting the washers and washer pole 10 about from place-to-place in the same game scoring package. Any appropriate disc or combination thereof could be used to form the magnetic pick-up.

In any event, and as will be appreciated, much less effort is required to pick up the washers from the ground, and without the need for anyone to significantly bend over and possibly fall when trying to retrieve the washers. All this follows from the pick up of the washers by the telescoping nature of the pole of the invention and by the magnetized components at the end of the section 12.

While there has been described what is considered to be a preferred embodiment of the invention, modifications can be made by those skilled in the art without departing from the scope of the teachings herein. For at least such reason, therefore, resort should be had to the claims appended hereto for a true understanding of the invention.

I claim:

1. For an accuracy scoring game having a target area towards which steel washers are tossed when playing, apparatus comprising: a washer retrieving pole including multiple sections capable of collapsing into one another for closure and storage and of extending from one another for opening and use; wherein said retrieving pole includes a first end for player hand grasping, and a second opposite end forming a first compartment of at least one embedded magnet for picking up steel washers from the ground; and wherein said retrieving pole additionally includes a first curvilinear portion, upwardly extending from a top side of said pole, in forming a second compartment securing said washers for storage when the accuracy scoring game is not being played.

2. The apparatus of claim 1 wherein said second compartment includes a circular disc overlain by a clasp spaced therefrom of a diameter and spacing to allow insertion of the washers during storage.

3. The apparatus of claim 1, also including a second curvilinear portion, downwardly extending from an underside of said pole in hooking to a player's belt, pockets or pants while washers are being tossed in the play of the game.

4. The apparatus of claim 1 wherein said retrieving pole is of a length of 9 inches when closed and of a length of 30 inches when opened.

5. The apparatus of claim 4 wherein said retrieving pole includes three interlocking sections of a length of 9 inches when the sections are closed and of a length of 30 inches when the sections are opened.

6. The apparatus of claim 4, and also including a first curvilinear portion, upwardly extending from a top side of said pole, in forming a second compartment securing said washers for storage when the accuracy scoring game is not being played.

7. The apparatus of claim 6, and also including a second curvilinear portion, downwardly extending from an underside of said pole in hooking to a player's belt, pockets or pants while washers are being tossed in the play of the game.

8. The apparatus of claim 7 wherein said second compartment includes a circular disc overlain by a clasp spaced therefrom of a diameter and spacing to allow insertion of the washers during storage.

9. The apparatus of claim 8 wherein said retrieving pole includes three interlocking sections of a length of 9 inches when the sections are closed and of a length of 30 inches when the sections are opened.

* * * * *